US007189085B1

(12) United States Patent
Yang

(10) Patent No.: US 7,189,085 B1
(45) Date of Patent: Mar. 13, 2007

(54) OUTDOOR SET OF PLUG AND SOCKET

(76) Inventor: Jerry S. C. Yang, 8F-8, No. 20, Ta Lung Rd., Taichung (TW)

( * ) Notice: Subject to any disclaimer, the term of this patent is extended or adjusted under 35 U.S.C. 154(b) by 0 days.

(21) Appl. No.: 11/306,126

(22) Filed: Dec. 16, 2005

(51) Int. Cl.
*H01R 13/44* (2006.01)

(52) U.S. Cl. ..... 439/144

(58) Field of Classification Search ..... 439/136, 439/521, 147, 142, 144; 220/242; 174/67
See application file for complete search history.

(56) References Cited

U.S. PATENT DOCUMENTS

| | | | | | |
|---|---|---|---|---|---|
| 1,872,367 | A * | 6/1932 | Van Emden | ..... | 439/144 |
| 3,239,791 | A * | 3/1966 | Fyrk | ..... | 439/144 |
| 3,659,248 | A * | 4/1972 | Mann et al. | ..... | 439/144 |
| 3,915,476 | A * | 10/1975 | Burkle | ..... | 280/422 |
| 4,037,907 | A * | 7/1977 | Klimek et al. | ..... | 439/142 |
| 4,061,407 | A * | 12/1977 | Snow | ..... | 439/35 |
| 4,072,381 | A * | 2/1978 | Burkhart et al. | ..... | 439/144 |
| 4,106,834 | A * | 8/1978 | Horowitz | ..... | 439/142 |
| 4,154,495 | A * | 5/1979 | Crewse | ..... | 439/35 |
| 4,245,875 | A * | 1/1981 | Shaffer et al. | ..... | 439/144 |
| 6,638,083 | B2 * | 10/2003 | Rhude | ..... | 439/142 |
| 6,802,725 | B2 * | 10/2004 | Rowland et al. | ..... | 439/144 |
| 6,851,958 | B1 * | 2/2005 | Rowland et al. | ..... | 439/142 |
| 2002/0142637 | A1 * | 10/2002 | Rhude | ..... | 439/142 |
| 2004/0161957 | A1 * | 8/2004 | Rowland et al. | ..... | 439/142 |

* cited by examiner

*Primary Examiner*—Ross Gushi
(74) *Attorney, Agent, or Firm*—Pai Patent & Trademark Law Firm; Chao-Chang David Pai

(57) ABSTRACT

An outdoor set of plug and socket comprises a control box, a plug and a socket box having at least a socket provided with a movable cover. The top surface of the plug is further provided with an uprightly erected wall having at least a retaining flange to be engaged with the recessed portion of the movable cover when the plug is inserted into a socket of the socket box. Thereby, the plug will be securely attached with the socket box.

3 Claims, 3 Drawing Sheets

OUTDOOR SET OF PLUG AND SOCKET

BACKGROUND OF THE INVENTION (a) Field of the Invention

The present invention relates to outdoor sets of plug and socket and more particularly to an outdoor set of plug and socket wherein a plug is further provided with an uprightly erected wall having at least a retaining flange to be engaged with a recessed portion of a movable cover of the socket when the plug is inserted into a socket of the socket box. Thereby, the plug will be securely attached with the socket box.

(b) Description of the Prior Art

Sets of plug and socket of the prior art mainly utilize the coupling between a plug and a socket box to achieve an electric connection for continuing electric power flow.

An outdoor set of plug and socket of the prior art comprises a plug, a control box integrally connected to the rear end of the plug, and a socket box for the insertion of the plug. The socket box has at least a socket provided with a movable cover, whereby the movable cover will retain the plug when it is inserted into a socket. Each socket can be a three-hole socket or a twin socket. However, the retaining effect of the movable cover, by simply tilting against the plug, is not strong enough to prevent the plug from falling off the socket when the plug is experiencing an external force.

SUMMARY OF THE INVENTION

The primary objective of the present invention is to provide an outdoor set of plug and socket comprising a control box, a plug and a socket box having at least a socket provided with a movable cover. The top surface of the plug is further provided with an uprightly erected wall having at least a retaining flange to be engaged with a recessed portion of the movable cover when the plug is inserted into a socket of the socket box. Thereby, the plug will be securely attached with the socket box, and any electrical shock resulting from a loose connection will be prevented.

The various objects and advantages of the present invention will be more readily understood from the following detailed description when read in conjunction with the appended drawings.

DETAILED DESCRIPTION OF THE PREFERRED EMBODIMENTS

Figure 1:
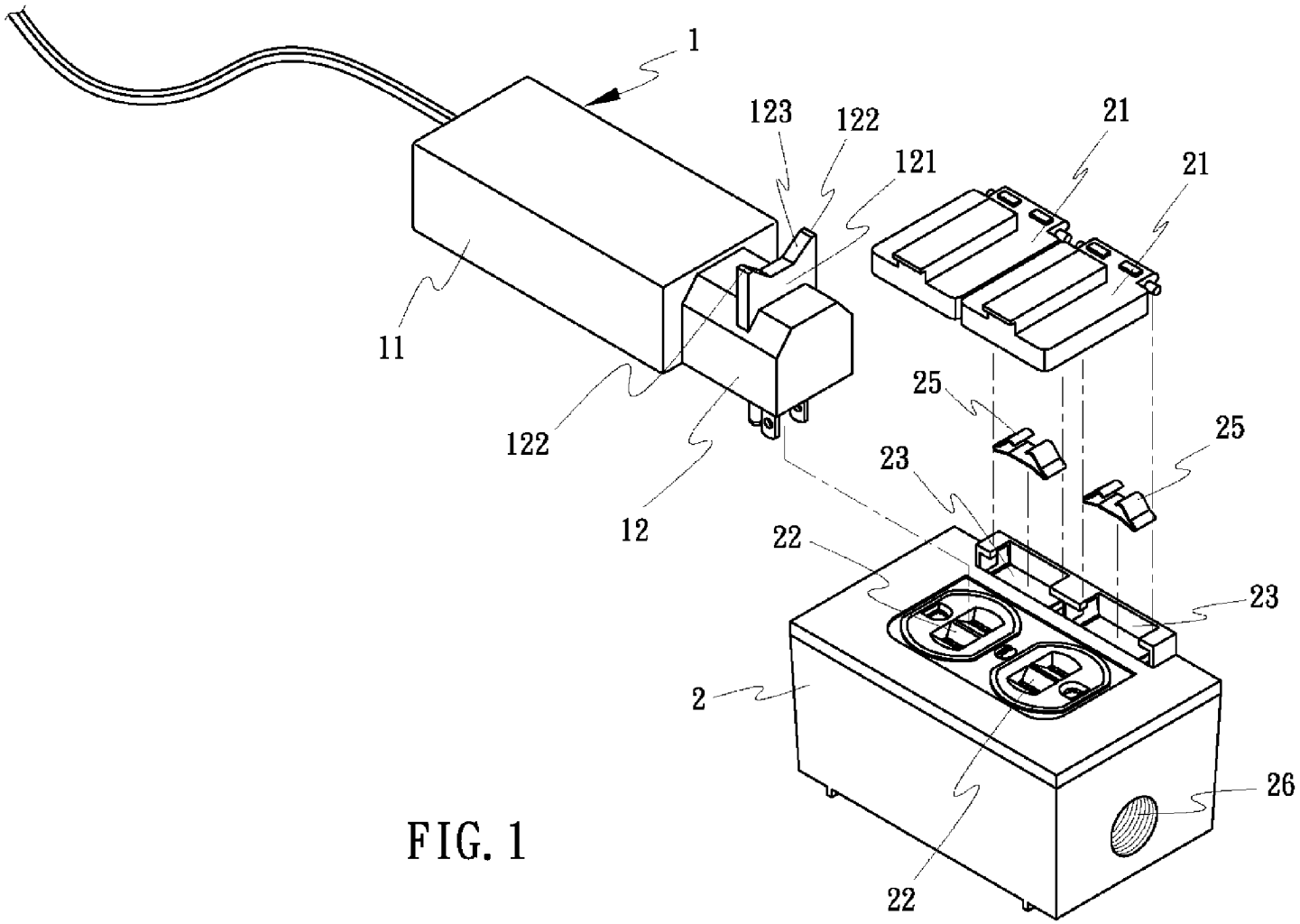
FIG. 1 is an exploded perspective view of an outdoor set of plug and socket of the present invention.
Figure 2:
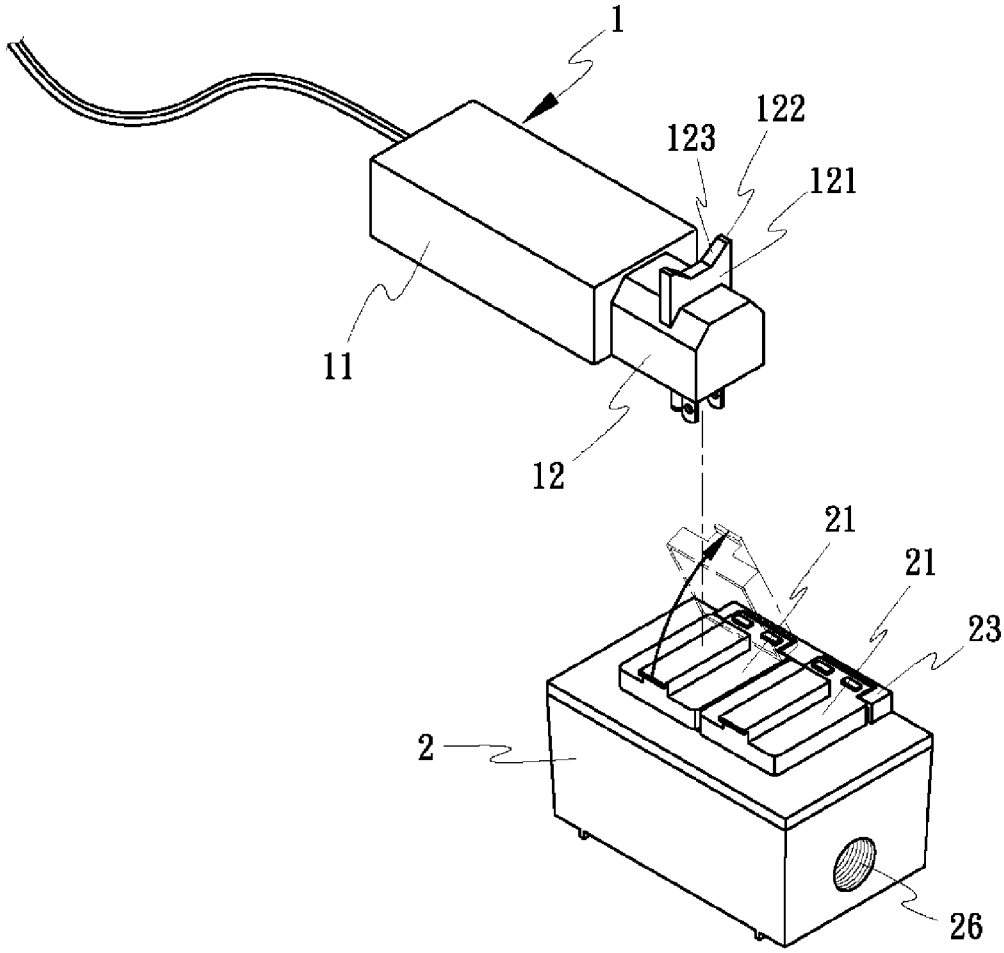
FIG. 2 is a perspective view of the outdoor set of plug and socket in FIG. 1 when the socket box is separated from the plug.
Figure 3:
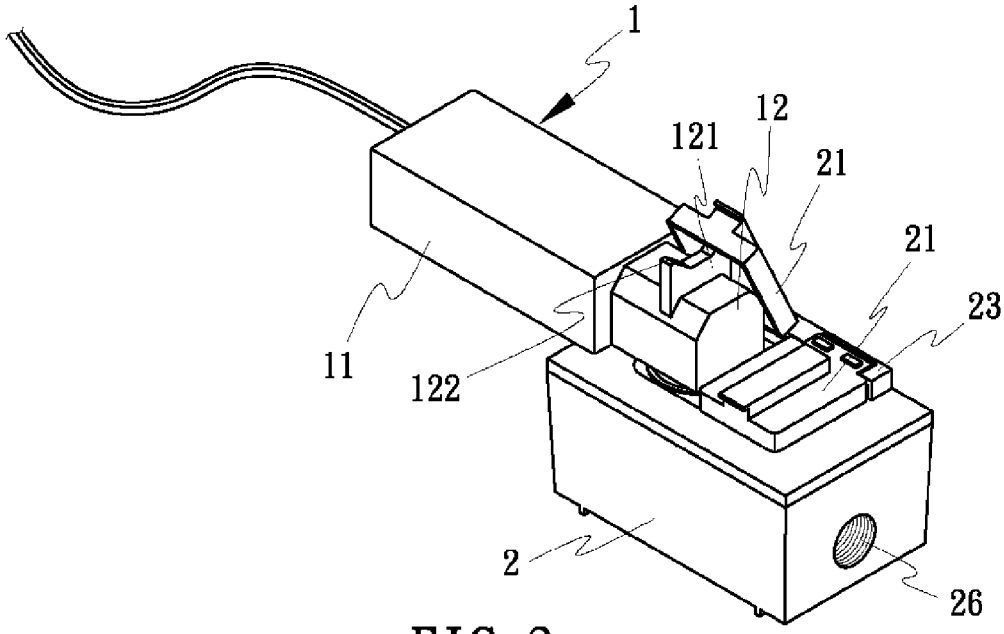
FIG. 3 is a perspective view of the outdoor set of plug and socket in FIG. 1 when the plug is inserted into the socket box.
Figure 4:
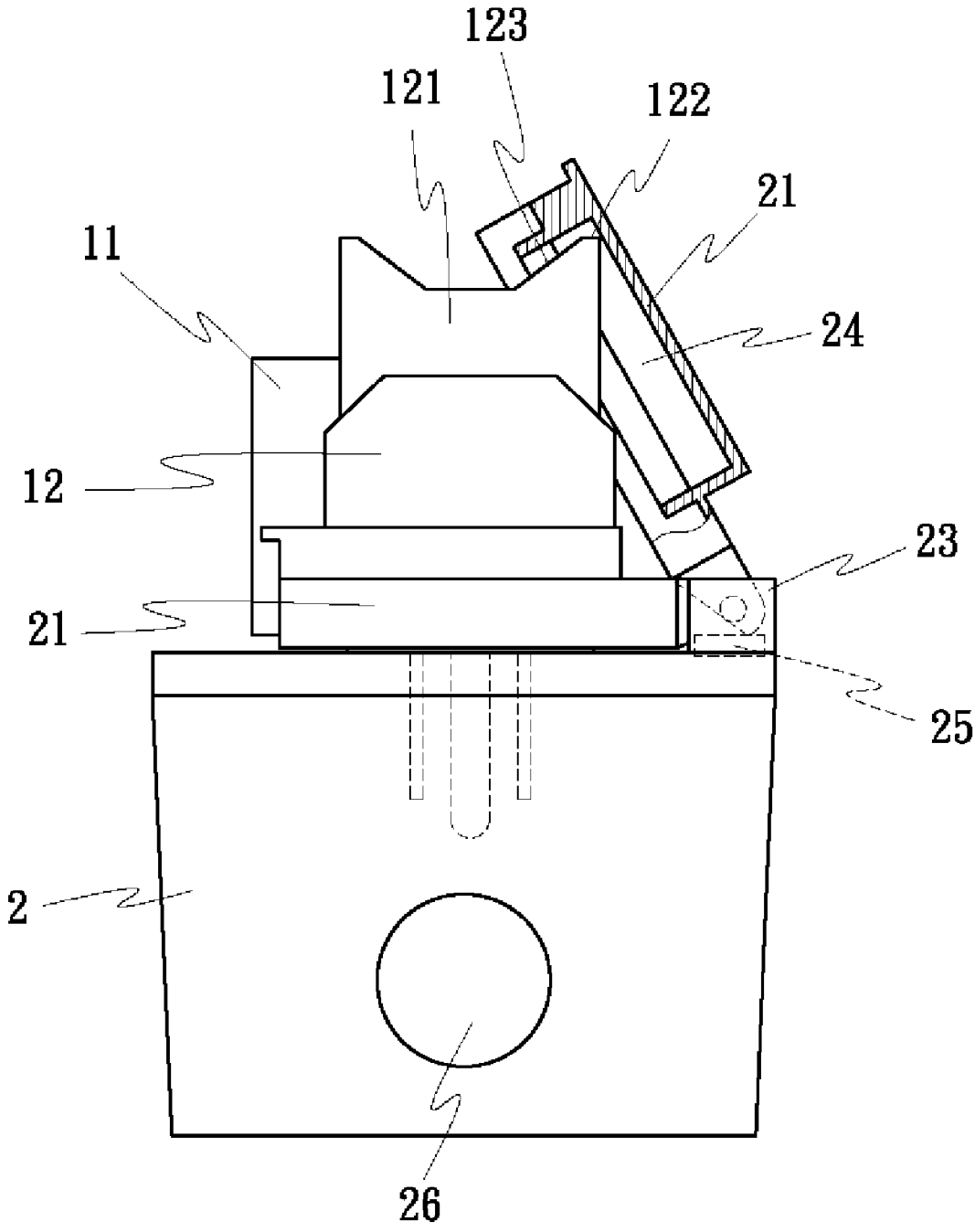
FIG. 4 is a side cross-sectional view of the outdoor set of plug and socket in FIG. 1 when the plug is inserted into the socket box.

Referring to FIGS. 1 to 4, an outdoor set of plug and socket 1 according to the present invention comprises a socket box 2 with at least a socket 22 attached with a movable cover 21. The configuration of the sockets 22 can be a three-hole socket, a twin socket or a socket of any other domestic or foreign specification. The socket box 2 can be a conventional outdoor socket box. Further, each of the sockets 22 has one side provided with a pivot mount 23 connected with the movable cover 21. Under each of the movable covers 21, there is a recessed portion 24, as shown in FIG. 4. Each of the pivot mounts 23 is further provided with a flexible supporting unit 25 for automatically flipping a corresponding movable cover 21 upward about the associated pivot mount 23. When each of the movable covers 21 is closed onto the corresponding socket 22, the associated flexible supporting unit 25 is in a stressed state.

The outdoor set of plug and socket 1 of the present invention further comprises a control box 11 and a plug 12. The plug 12 is provided with an uprightly erected wall 121 having retaining flanges 122 on two sides or a retaining flange 122 on a selected side, whereby the recessed portions 24 of a movable cover 21 can be engaged with a corresponding retaining flange 122, and whereby the plug 12 can be securely retained on one of the sockets 22 of the socket box 2, as shown in FIGS. 3 and 4. The retaining structure will prevent the plug 12 from falling off the socket box 2 and any electrical shock thereby induced.

The plug 12 is not restricted to any particular type, and a retaining flange 122 on one side of the plug 12 capable of being engaged with the recessed portion 24 under the movable cover 21 of a socket box 2 will suffice and is not restricted to any particular shape.

Further, each of the retaining flanges 122 has an inwardly inclined top edge 123 for guiding the erected wall 121 into the recessed portion 24 of a corresponding movable cover 21.

The plug 12 is integrally combined with the control box 111 that is provided with a predetermined control circuit (including a PC board) and an adapter. The inner space of the plug 12 is filled with insulating glue so that it is water-proof and can be used outdoors. Further, two lateral sides of the socket box 2 are each provided with a hole with a screw thread 26, so that a tube of wires can go through the socket box 2.

The present invention is thus described, and it will be obvious that the same may be varied in many ways. Such variations are not to be regarded as a departure from the spirit and scope of the present invention, and all such modifications as would be considered equivalent in the art are intended to be included within the scope of the following claims.

What is claimed is:

1. An outdoor set of plug and socket, comprising:

a socket box having at least a socket, one side of said socket being attached with a pivotally and flexibly movable cover pivoted to a pivot mount provided with a flexible supporting unit, a bottom side of said movable cover being provided with a recessed portion; and a plug having conducting prongs for inserting into one of said sockets and an uprightly erected wall thereon, said erected wall extending in a direction opposite to said conducting prongs of the plug and having at least a retaining flange on one side thereof, whereby said plug can be engaged with said recessed portion of one of said movable covers to be securely attached with said socket box when said plug is inserted into one of said sockets of said socket box, wherein the flexible supporting unit automatically flips the corresponding movable cover upward about the associated pivot mount when the movable cover is not engaged with the plug.

2. The outdoor set of plug and socket of claim 1, wherein each of said retaining flanges has an inwardly inclined top edge for guiding said erected wall into the recessed portion of a corresponding one of said movable covers.

3. An outdoor set of plug and socket, comprising:

a socket box having at least a socket one side of said socket being attached with a pivotally and flexibly movable cover, a bottom side of said movable cover being provided with a recessed portion;

a plug having an uprightly erected wall thereon said erected wall having at least a retaining flange on one side thereof whereby said plug can be engaged with said recessed portion of one of said movable covers to be securely attached with said socket box when said plug is inserted into one of said sockets of said socket box; and a control box integrally connected with said plug.

* * * * *